US007019732B2

(12) United States Patent
Furukawa

(10) Patent No.: US 7,019,732 B2
(45) Date of Patent: Mar. 28, 2006

(54) JOYSTICK

(75) Inventor: Hitoshi Furukawa, Tokyo (JP)

(73) Assignee: Mitsumi Electric Co., Ltd., Tokyo (JP)

( * ) Notice: Subject to any disclaimer, the term of this patent is extended or adjusted under 35 U.S.C. 154(b) by 274 days.

(21) Appl. No.: 10/350,004

(22) Filed: Jan. 24, 2003

(65) Prior Publication Data

US 2003/0144752 A1 Jul. 31, 2003

(30) Foreign Application Priority Data

Jan. 30, 2002 (JP) ..... P2002-022399

(51) Int. Cl.
*G09G 5/08* (2006.01)

(52) U.S. Cl. ..... 345/161; 74/471 XY

(58) Field of Classification Search ..... 345/156–169; 74/174 XY, 471 XY
See application file for complete search history.

(56) References Cited

U.S. PATENT DOCUMENTS 5,436,640 A * 7/1995 Reeves ..... 345/161
5,473,325 A * 12/1995 McAlindon ..... 341/20
5,589,854 A * 12/1996 Tsai ..... 345/161
6,064,369 A * 5/2000 Okabe et al. ..... 345/161
6,654,005 B1 * 11/2003 Wang ..... 345/161
6,670,945 B1 * 12/2003 Nakamura ..... 345/156
2002/0005833 A1 * 1/2002 Furukawa et al. ..... 345/161

* cited by examiner

*Primary Examiner*—Vijay Shankar
*Assistant Examiner*—Steven Holton
(74) *Attorney, Agent, or Firm*—Whitham, Curtis, Christofferson & Cook, P.C.

(57) ABSTRACT

A joystick includes an operating stick having shaft portions protruded from a lower end thereof, an upper arm which supports the operating stick so as to be pivotable in a first direction, a lower arm which supports the operating stick so as to be pivotable in a second direction which is perpendicular to the first direction, and bearing portions which are formed at a lower face of the central portion of the lower arm for bearing the shaft portions. The bearing portions are concaved, and the shaft portions are fitted into the bearing portions from a lower side respectively.

2 Claims, 6 Drawing Sheets

JOYSTICK

BACKGROUND OF THE INVENTION

The present invention relates to a joystick and, in particular, relates to a compact joystick in which an arm member has a wall thickness suitable to strengthen and improve the durability thereof.

Joysticks disclosed in the related prior art will be explained with reference to FIGS. 7 and 8. In the figures, a joystick 1 is configured in a manner that the arms 3 and 4 being orthogonal to each other in the vertical direction are disposed so as to rotate freely within a casing 2. Each of the arms 3 and 4 is pivotally supported at both end portions thereof by the casing 2. The one end portions of the arms 3 and 4 are connected to variable resistors 5, 6 serving as signal output units, respectively.

Long holes 7, 8 extending in the longitudinal directions of the arms 3, 4 are opened at the center portions of the arms 3, 4, respectively. An operation stick 9 serving as an operation stick is provided so as to pass through the long holes 7, 8. The lower end portion of the operation stick 9 is formed as a convex-shaped spherical portion 9*a*. A concave-shaped spherical portion 10*a* is formed at the center portion of the base 10 of the joystick 1. The convex-shaped spherical portion 9*a* is disposed at the concave-shaped spherical portion 10*a* so as to rotate freely. A knob (not shown) is fitted into the upper end portion of the operation stick 9.

When the operation stick 9 is operated, the operation stick 9 rotates around the concave-shaped spherical portion 10*a* serving as a rotation fulcrum, then the operation stick 9 rotates the arms 3 and 4 thereby to rotate the variable resistors 5 and 6 coupled to the arms 3 and 4, so that the variable resistors 5 and 6 generate outputs according to the operation of the operation stick 9.

Further, as shown in FIG. 8, the operation stick 9 of the joystick 1 has shaft portions 11 protrusively provided at the left and right portions of the lower portion thereof, respectively. The shaft portions 11 are fitted into shaft holes 13, which are formed at the center portions of inside wall portions 12, 12 forming the long hole 8 perforated at the lower arm 4, in a pin-coupling method so as to rotate freely, respectively. Then, the operation stick 9 and the arms 3, 4 are fixed in the vertical direction. In order to hold the arms 3, 4 at the neutral portions, a coil spring 15 is disposed between the base 10 and a ring-shaped supporting member 14 which is largely perforated at the center portion thereof abutting against the lower face of the lower arm 4 and has a reverse-U shape in its section.

However, according to the related compact joystick, the shaft portions protrusively provided at the lower portion of the operation stick are forcedly inserted and fitted into the shaft holes perforated at the lower side arm so as to rotate freely.

Thus, when a user operates such a compact joystick heavily, an intense force acts on the arm which tries to restore to the neutral position due to the coil spring. In particular, a more load is applied to the arm near the shaft portions of the operation stick due to a load applied from the upper side and action of a lever. Thus, the arm deforms due to the load and so the durability of the joystick is remarkably degraded. Such a phenomenon appears remarkably in the case of a compact joystick formed by processing plastics.

SUMMARY OF THE INVENTION

It is therefore an object of the present invention to provide a rigid and durable joystick that prevents deformation of an arm, even if a user heavily operates the compact joystick.

In order to achieve the above object, according to the present invention, there is provided a joystick comprising:

an operating stick, having shaft portions protruded from a lower end thereof;

an upper arm, which supports the operating stick so as to be pivotable in a first direction;

a lower arm, which supports the operating stick so as to be pivotable in a second direction which is perpendicular to the first direction; and bearing portions, which are formed at a lower face of the central portion of the lower arm for bearing the shaft portions, and the bearing portions being concaved;

wherein the shaft portions are fitted into the bearing portions from a lower side respectively.

In the above configuration, the lower arm is provided with bearing portions being opened at their lower faces which are formed by removing the lower faces of the center portions of both the side wall portions forming a long hole passed through the operating stick in almost semicircular shapes, respectively, and the shaft portions of the operation stick are abutted against and fitted into the bearing portions from a lower side, respectively. Thus, unlike the related example, the operation stick is not required to be fitted into the shaft hole perforated at the arm by utilizing the elasticity of the arm. Thus, it is possible to make the arm well rounded or fat.

Preferably, the shaft portions have different diameters, and the bearing portions into which the shaft portions is fitted have corresponding diameters respectively.

Preferably, the bearing portions are semicircular recessed portions.

In the above configurations, the arm is removed in its thickness by a size corresponding to the moving amount of the operation stick, that is, only for portions corresponding to the long hole provided at a longitudinal direction of the arm and the bearing portions being opened in their lower face for fitting the shaft portions therein. Thus, the arm becomes more rigid and the durability thereof is remarkably improved. Accordingly, the invention can attain quite remarkable effects.

BRIEF DESCRIPTION OF THE DRAWINGS

The above objects and advantages of the present invention will become more apparent by describing in detail preferred exemplary embodiments thereof with reference to the accompanying drawings, wherein.

DETAILED DESCRIPTION OF THE PREFERRED EMBODIMENTS

The embodiment of the invention will be explained in detail with reference to FIGS. 1 to 6. In this respect, portions same as those of the related technique are explained for the convenience of explanation.

Figure 1:
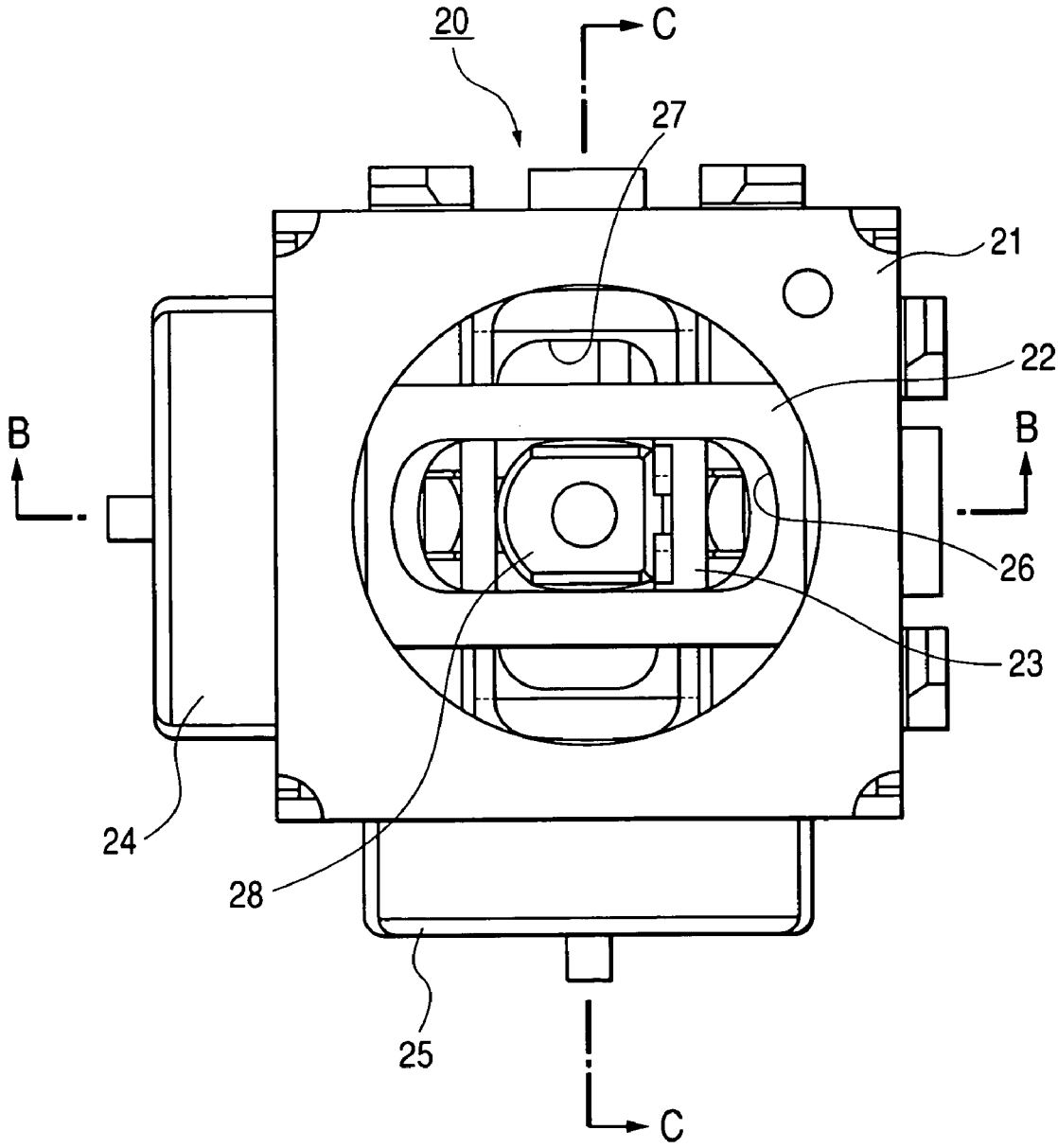
FIG. 1 is a plan view of a joystick according to an embodiment of the invention.

In FIG. 1, a reference numeral 20 depicts a joystick. The joystick 20 is configured in a manner that an upper arm 22 serving as an upper arm and a lower arm 23 being orthogonal to each other in the vertical direction are disposed so as to rotate freely within a casing 21. Each of the upper arm 22 and the lower arm 23 is pivotally supported at both end portions thereof by the casing 21. The one end portions of the upper arm 22 and the lower arm 23 are connected to variable resistors 24, 25, respectively.

Long holes 26, 27 extending in the axial directions of the upper arm 22 and the lower arm 23 are opened at the center portions thereof, respectively. An operation stick 28 is provided so as to pass through the long holes 26, 27. The lower end portion of the operation stick 28 is formed as a convex-shaped spherical portion 28*a*. A concave-shaped spherical portion 21*a* is formed at the center portion of the upper portion of the base 21*b* of the joystick 20. The convex-shaped spherical portion 28*a* is disposed on the concave-shaped spherical portion 21*a* so as to swing freely. A knob (not shown) is fitted into the upper end portion of the operation stick 28.

In the joystick 20 thus configured, When the operation stick 28 is operated, the operation stick 28 rotates around the concave-shaped spherical portion 21*a* serving as a rotation fulcrum, then the operation stick rotates the upper arm 22 and the lower arm 23 thereby to rotate the variable resistors 24 and 25 coupled to the upper arm 22 and the lower arm 23, respectively, so that the variable resistors 24 and 25 generate outputs according to the operation of the operation stick 28.

In order to hold the upper arm 22 and the lower arm 23 respectively at the neutral positions, like the related example, a coil spring 30 is disposed between the base 21*b* and a ring-shaped supporting member 29 which is abutted against the lower face of the lower arm 23. That is, since the coil spring 30 elastically pushes the lower arm 23 upward, the upper arm 22 and the lower arm 23 are held at the neutral positions, respectively.

Figure 2:
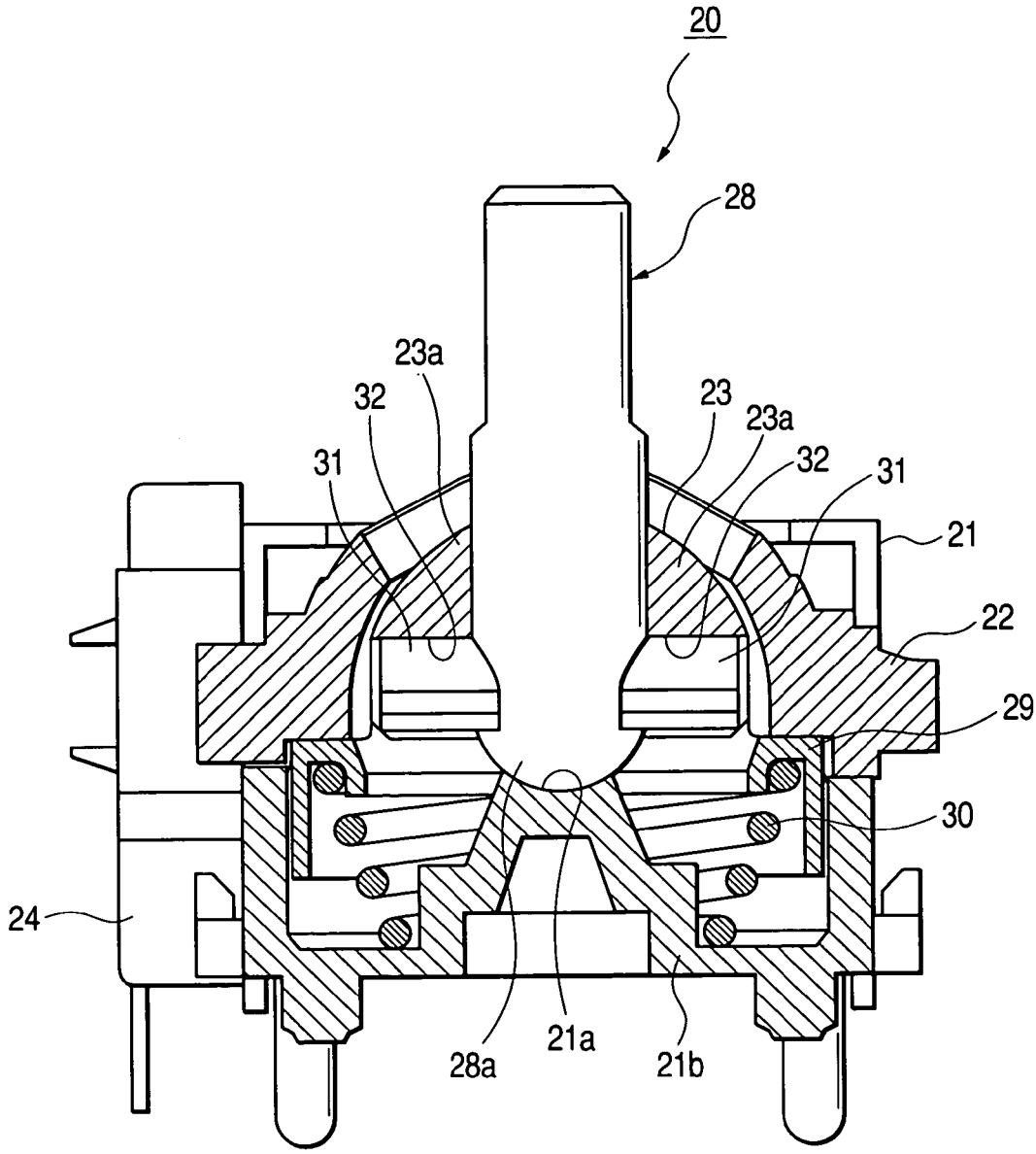
FIG. 2 is a sectional view along a line B—B in FIG. 1.
Figure 3:
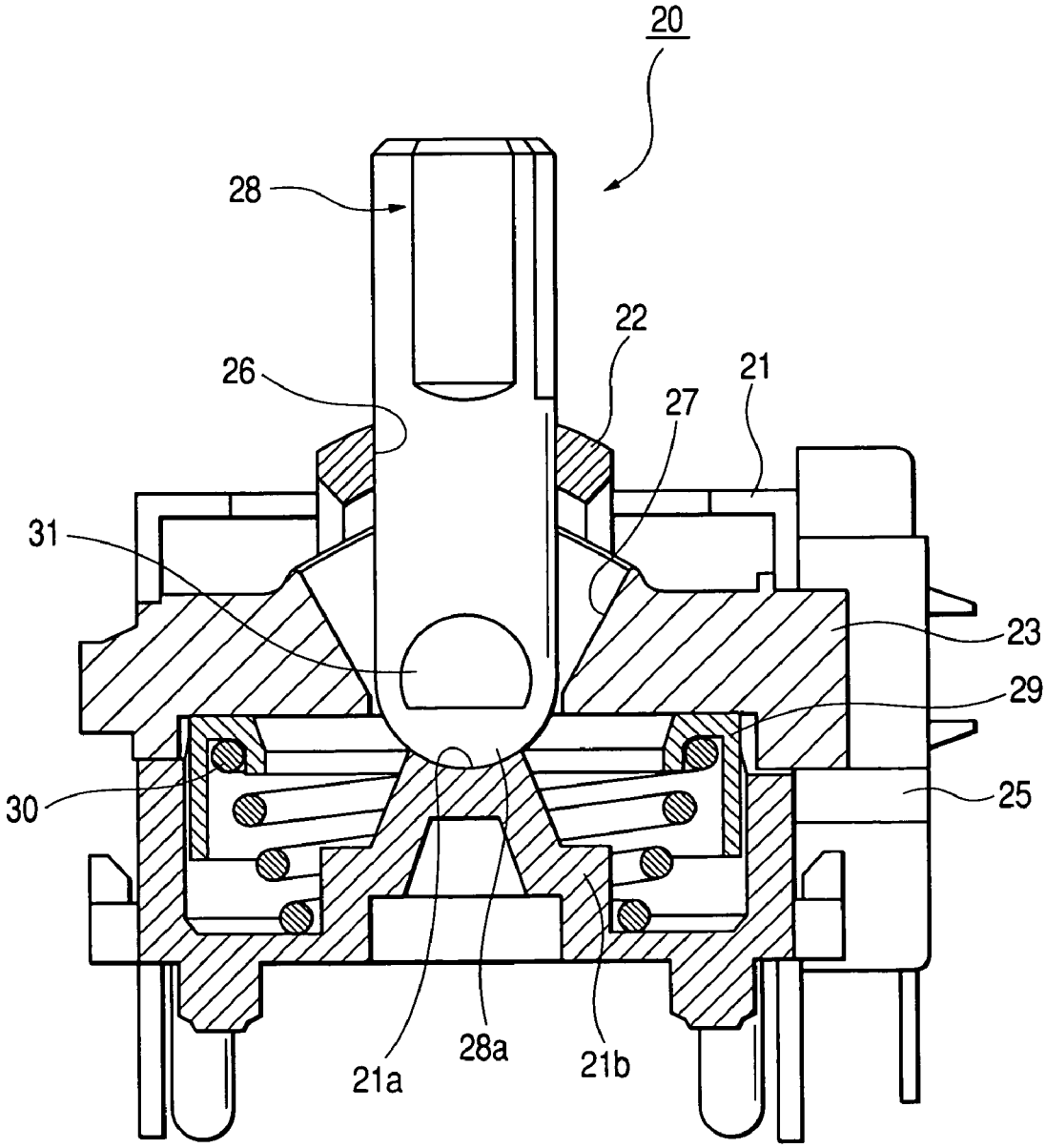
FIG. 3 is a sectional view along a line C—C in FIG. 1.
Figure 4:
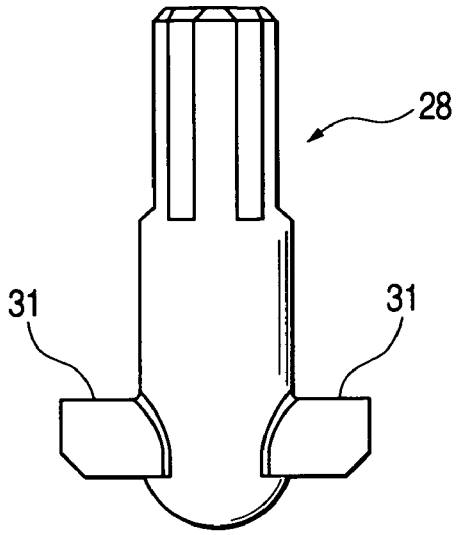
FIG. 4 is a perspective view of an operation stick.
Figure 5A:
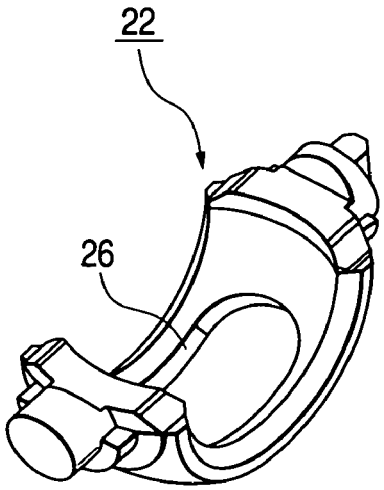
FIG. 5A is a perspective view of an upper arm seen from the lower side.
Figure 5B:
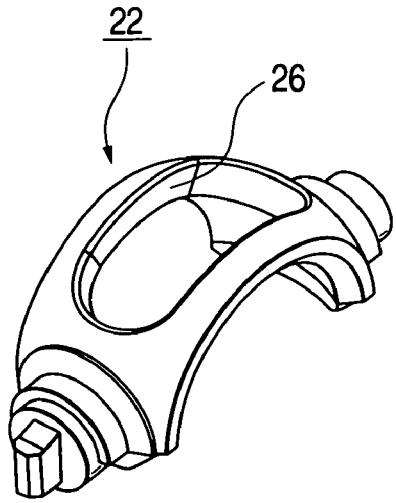
FIG. 5B is a perspective view of the upper arm seen from the upper side.

Further, the operation stick 28 is provided with shaft portions 31 protrusively provided at the left and right portions of the lower portion of the operation stick 28 as shown in FIGS. 2 and 4.

Figure 6A:
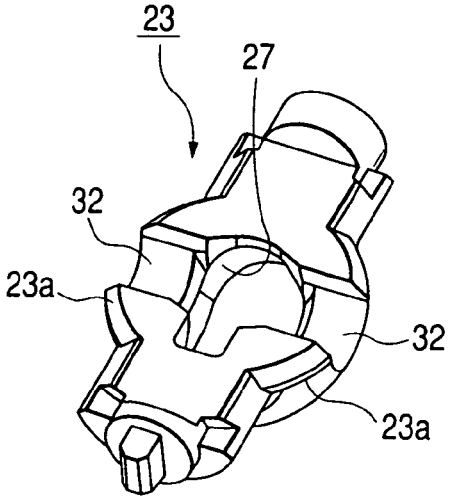
FIG. 6A is a perspective view of an lower arm seen from the lower side.
Figure 6B:
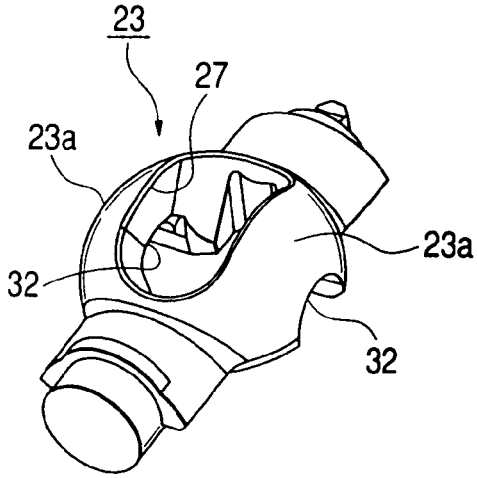
FIG. 6B is a perspective view of the lower arm seen from the upper side.
Figure 7:
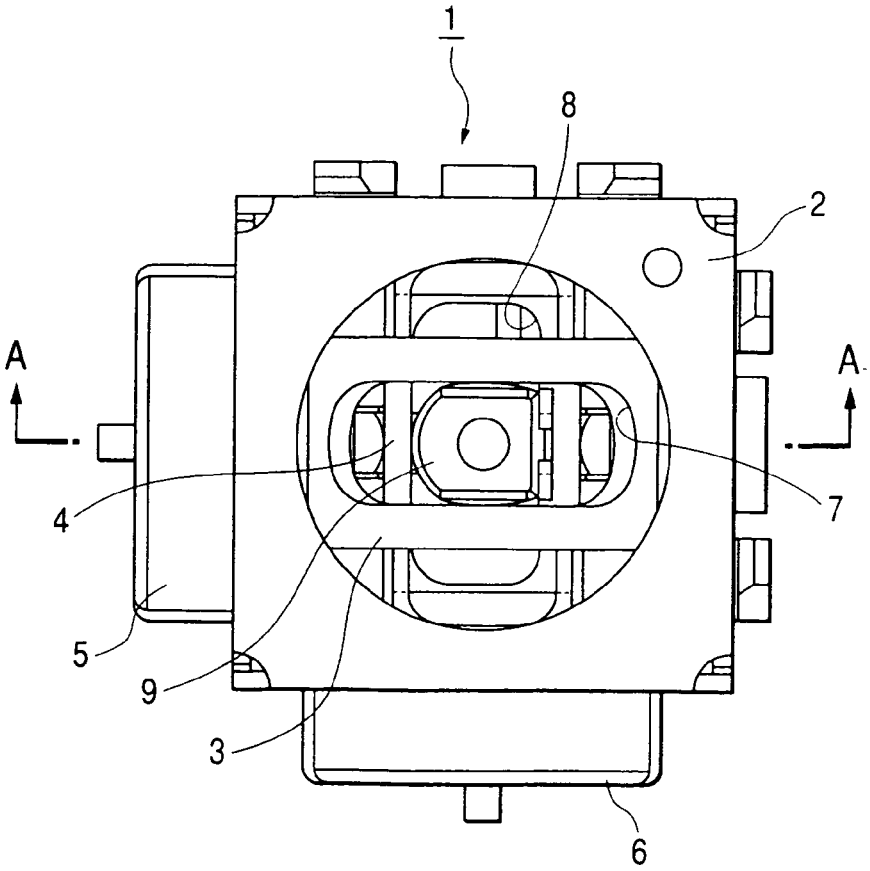
FIG. 7 PRIOR ART
FIG. 7 is a plan view of an example of related joysticks.
Figure 8:
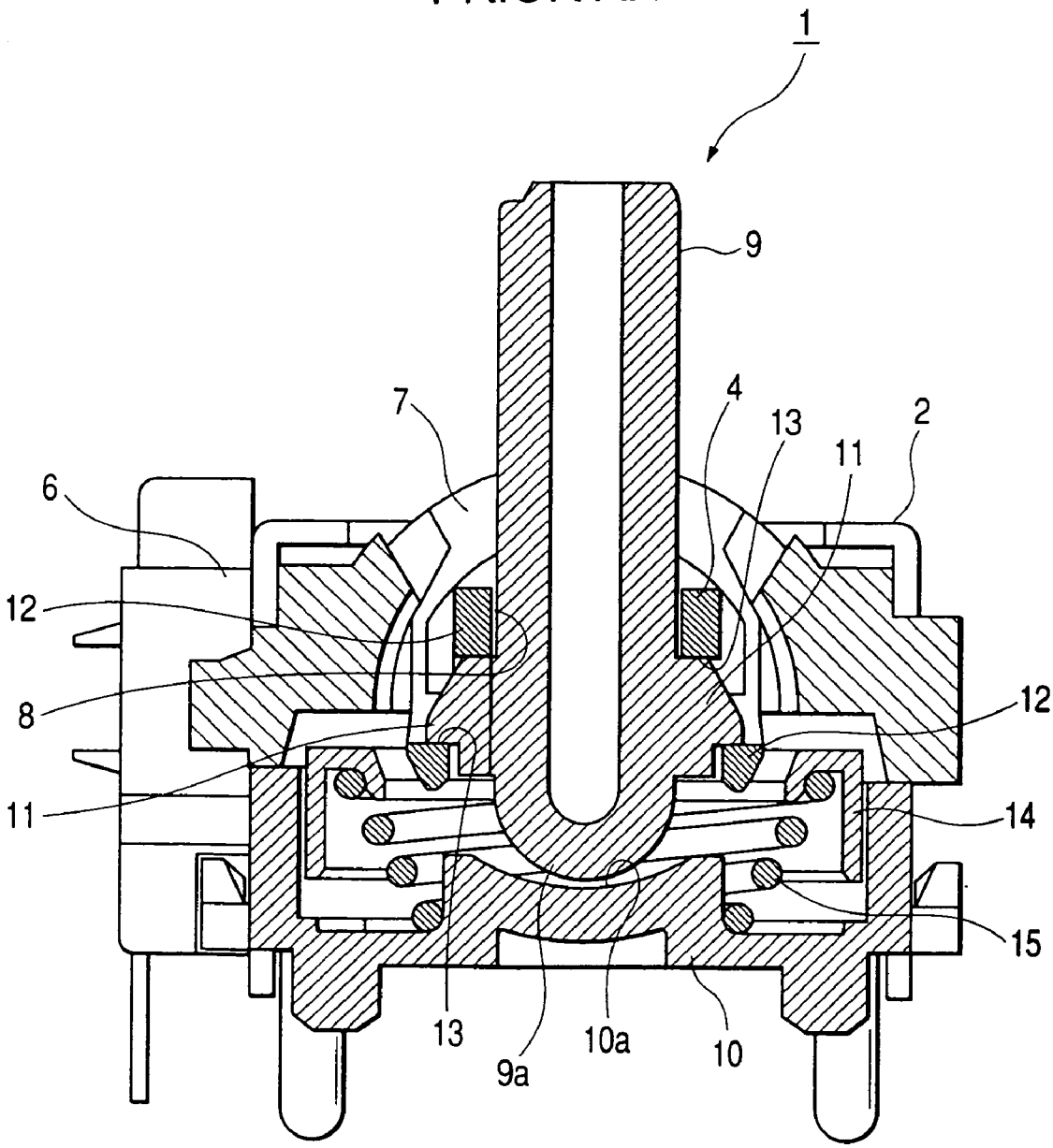
FIG. 8 PRIOR ART
FIG. 8 is a sectional view along a line A—A in FIG. 7.

As shown in FIGS. 2 and 6, the lower arm 23 has the side wall portions 23*a* formed by the long hole 27. Bearing portions 32 are formed at the lower faces of the center portions of the left and right side wall portions 23*a* in almost recessed semicircular shapes, respectively. Thus, the bearing portions 32 are provided in a manner that the lower faces thereof are opened at the side wall portions 23*a* of the lower arm 23, respectively. Further, the bearing portions 32 are formed to have sizes corresponding to the sizes of the shaft portions 31 which are provided at the operation stick 28 so that the shaft portions are fitted in loosely in the bearing portions. Furthermore, the left and right shaft portions 31 are formed to have different sizes and the bearing portions 32 corresponding thereto also are formed to have different sizes. In the event that the shaft portions are mistakenly fitted in loosely in erroneous bearing portions in a manner that the left and right directions are erroneous, the shaft portions 31 of the operation stick 28 can not be fitted into the bearing portions 32, respectively. Thus, there is no possibility that the operation stick 28 is attached in an erroneous direction.

Further, since the shaft portions 31 are loosely fitted in from the lower faces of the corresponding bearing portions 32, respectively, such a mutual fitting operation can be performed easily. The shaft portions 31 are prevented from moving upward due to the presence of the bearing portions 32. Thus, the bearing portions also serve for preventing the operation stick 28 from dropping out and the shaft portions 31 fit in the lower arm 23 and rotate. Further, the shaft portions 31 coincide with the shafts of the upper arm 22 and the lower arm 23 serving as the upper and lower arms, respectively. The operation stick 28 is prevented from being pushed in by the concave-shaped spherical portion 21*a* provided at the base 21*b*.

In this manner, the joystick 20 is provided with a restriction portion for restricting the assembling direction to a predetermined direction in order to prevent the erroneous assembling. To this end, the respective parts are subjected to various improvement for their configurations and then assembled within the casing 21, and so the joystick is configured to attain its function smoothly.

As described above, unlike the related example, the operation stick 28 of the joystick 20 according to the invention is not required to be fitted into the shaft hole perforated at the lower arm 23 by utilizing the elasticity of the lower arm 23. Thus, it is possible to make the lower arm 23 wall thicker. Further, the lower arm 23 is removed in its thickness by a size corresponding to the moving amount of the operation stick 28, that is, only for portions corresponding to the long hole 27 and the bearing portions 32 for fitting the shaft portions 31 therein. Thus, particularly, the lower arm 23 becomes more rigid and the durability thereof it improved. Accordingly, such a problem that the arms are deformed or broken can be prevented from occurring even if a user heavily operates the joystick 20. It is considered to provide sphere portions at the lower portion of the operation stick 28 in place of the shaft portions 31. However, in this case, if bearing portions are provided at the arm in correspondence with the sphere portions, the lower arm is largely removed in its thickness at portions corresponding to the bearing portions. As a result, it becomes almost impossible to firmly hold the arms and expect the durability.

What is claimed is:

1. A joystick, comprising:

an operating stick, having shaft portions protruded from a lower end thereof;

an upper arm, which supports the operating stick so as to be pivotable in a first direction;

a lower arm, which supports the operating stick so as to be pivotable in a second direction which is perpendicular to the first direction; and bearing portions which are formed at a lower face of the central portion of the lower arm for bearing against the shaft portions, and the bearing portions being concaved;

wherein the shaft portions are fitted into the bearing portions from a lower side respectively, wherein the shaft portions have different diameters; and wherein the bearing portions into which the shaft portions are fitted have corresponding diameters respectively.

2. The joystick as set forth in claim 1, wherein the bearing portions are semicircular recessed portions.

* * * * *